US009788634B2

(12) United States Patent
Wang

(10) Patent No.: US 9,788,634 B2
(45) Date of Patent: Oct. 17, 2017

(54) QUANTITATIVE DISPENSING DEVICE

(71) Applicant: WELL MAX BEAUTY LAB CO., LTD., Tainan (TW)

(72) Inventor: Teng-Huei Wang, Tainan (TW)

(73) Assignee: WELL MAX BEAUTY LAB CO., LTD., Tainan (TW)

( * ) Notice: Subject to any disclaimer, the term of this patent is extended or adjusted under 35 U.S.C. 154(b) by 159 days.

(21) Appl. No.: 14/971,410

(22) Filed: Dec. 16, 2015

(65) Prior Publication Data

US 2017/0172283 A1 Jun. 22, 2017

(51) Int. Cl.

| | |
|---|---|
| ***B65D 37/00*** | (2006.01) |
| ***A45D 40/00*** | (2006.01) |
| ***B05B 11/00*** | (2006.01) |
| ***A45D 34/00*** | (2006.01) |

(52) U.S. Cl.

CPC ..... *A45D 40/0075* (2013.01); *A45D 34/00* (2013.01); *B05B 11/3047* (2013.01); *B05B 11/3059* (2013.01)

(58) Field of Classification Search

CPC A45D 40/0075; A45D 34/00; B05B 11/3047; B05B 11/3059

USPC ..... 222/209, 309, 384, 41–47, 490; 141/22, 141/24; 604/295, 298; 422/501–505

See application file for complete search history.

(56) References Cited

U.S. PATENT DOCUMENTS

2011/0226810 A1* 9/2011 Wang ..... B05B 11/0027 222/129
2011/0226812 A1* 9/2011 Wang ..... B05B 11/0027 222/145.1
2014/0209206 A1* 7/2014 Wang ..... G01F 11/084 141/24
2014/0209636 A1* 7/2014 Wang ..... B05B 11/3002 222/153.13
2015/0320175 A1* 11/2015 Lee ..... A45D 34/00 222/372

* cited by examiner

*Primary Examiner* — Jeremy W Carroll
(74) *Attorney, Agent, or Firm* — Muncy, Geissler, Olds & Lowe, P.C.

(57) ABSTRACT

A quantitative dispensing device includes amounting seat, an elastic cap, a dispensing element, a regulating member, a rotatable seat and a press button that has a positioning unit. The regulating member includes a regulating unit that has a stepped-shaped top surface having a plurality of contacting surface portions. The press button is movable between a raised position, where the positioning unit is spaced apart from a selected one of the contacting surface portions, and a pressed position, where the positioning unit abuts against the selected one of the contacting surface portions and the press button is pressed downwardly against the elastic cap.

12 Claims, 4 Drawing Sheets

QUANTITATIVE DISPENSING DEVICE

FIELD

The disclosure relates to a dispensing device, more particularly to a quantitative dispensing device that is capable of dispensing a preselected quantity of flowable material.

BACKGROUND

Beauty product or skin care product, such as lotion or serum, is usually contained in a bottle configured with a hollow tube and a press head that is connected to the hollow tube, and that can be pressed manually for dispensing the product in droplet form or in spray form. When the product is about to be consumed, the bottle may fail to dispense a last bit of the product that is remained in the hollow tube, thereby resulting in an undesirable waste of the product. Therefore, high-end skin care product is usually designed to be contained in a bottle configured with a dropper. However, it is relatively difficult for a user to control the total amount of the high-end skin care product that is dispensed out using the dropper. Moreover, even if the dropper is provided with graduation marks, a user has to spend extra effort to read the graduation marks for precisely dispensing a desirable amount of the high-end skin care product, which is relatively inconvenient and laborious.

SUMMARY

Therefore, an object of the disclosure is to provide a quantitative dispensing device that can alleviate at least one of the aforesaid drawbacks of the prior arts.

According to an aspect of the present disclosure, the quantitative dispensing device is used for dispensing a preselected quantity of flowable material. The quantitative dispensing device includes a mounting seat, an elastic cap, a hollow dispensing element, a regulating member, a rotatable seat and a press button.

The mounting seat includes a hollow base body and a first surrounding wall. The first surrounding wall extends upwardly from the base body, defines an accommodating space, and includes a slide slot unit extending downwardly from a top edge of the first surrounding wall. The elastic cap is fixedly disposed in the accommodating space and defines an air-containing space. The hollow dispensing element includes an upper open end that is connected to the elastic cap, and a lower open end that is opposite to the upper open end. The regulating member is sleeved on the first surrounding wall of the mounting seat, is rotatable relative to the mounting seat, and includes a main body that includes at least one regulating unit. The at least one regulating unit has a stepped-shaped top surface that has a plurality of contacting surface portions having different heights away from a bottom edge of the main body. The rotatable seat is disposed on and connected to an outer surface of the regulating member, is co-rotatable with the regulating member relative to the mounting seat, and is operable to rotate so as to permit a selected one of the contacting surface portions to correspond in position to the slide slot unit of the mounting seat.

The press button is disposed above the elastic cap and includes a positioning unit that is slidable along the slide slot unit. The press button is movable in a movement direction relative to the mounting seat between a raised position, where the positioning unit is spaced apart from the selected one of the contacting surface portions and the press button is not pressed downwardly against the elastic cap, and a pressed position, where the positioning unit abuts against the selected one of the contacting surface portions and the press button is pressed downwardly against the elastic cap, so that the elastic cap is deformed to expel air from the air-containing space through the dispensing element, and that the elastic cap stores a restoring force capable of returning the press button to the raised position and generates a suction force for drawing the flowable material into the dispensing element when the press button is released.

BRIEF DESCRIPTION OF THE DRAWINGS

Other features and advantages of the disclosure will become apparent in the following detailed description of the exemplary embodiment with reference to the accompanying drawings, of which.

DETAILED DESCRIPTION

Figure 1:
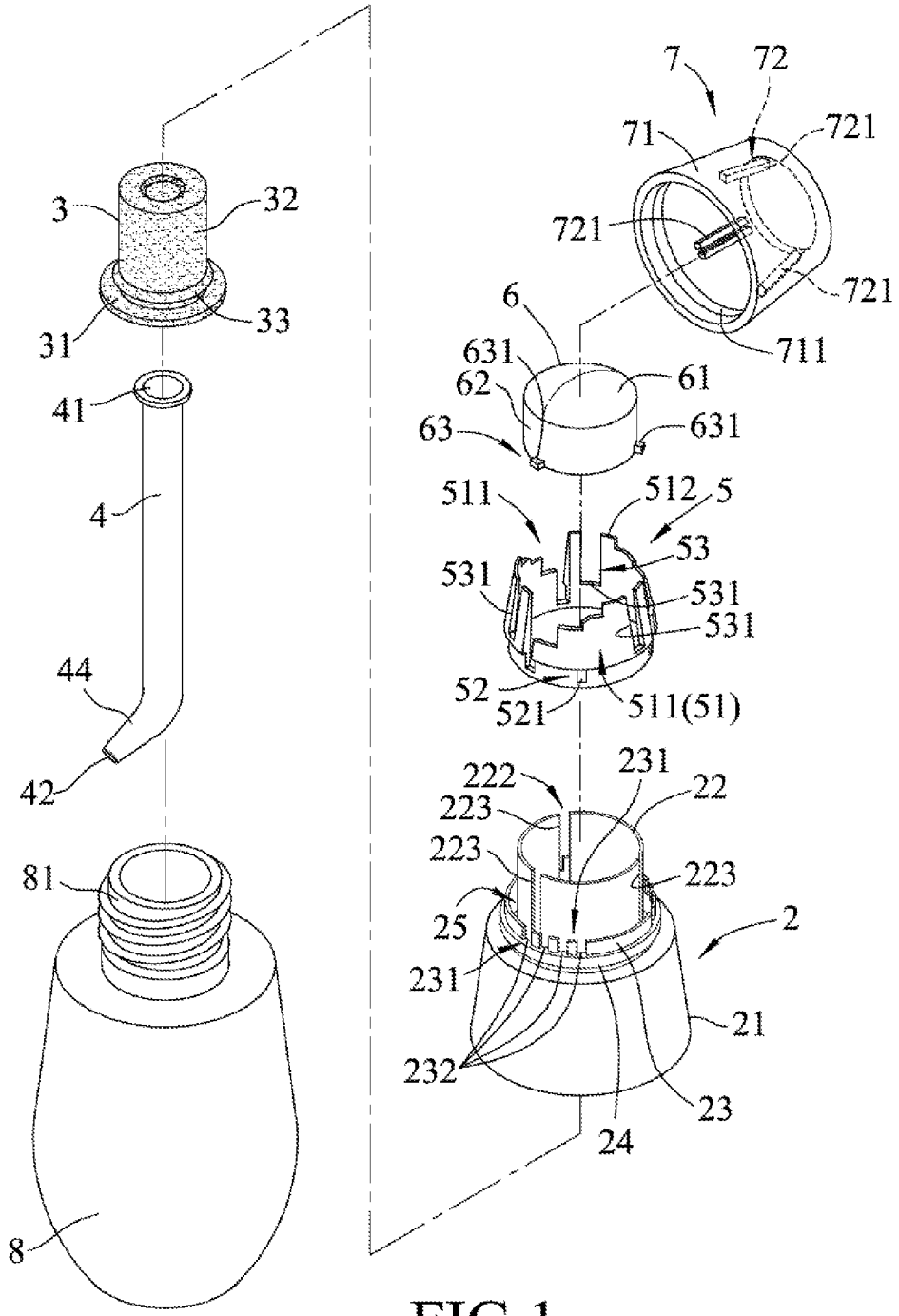
FIG. 1 is an exploded perspective view illustrating an exemplary embodiment of a quantitative dispensing device according to the disclosure and a container to which the quantitative dispensing device is to be mounted.
Figure 2:
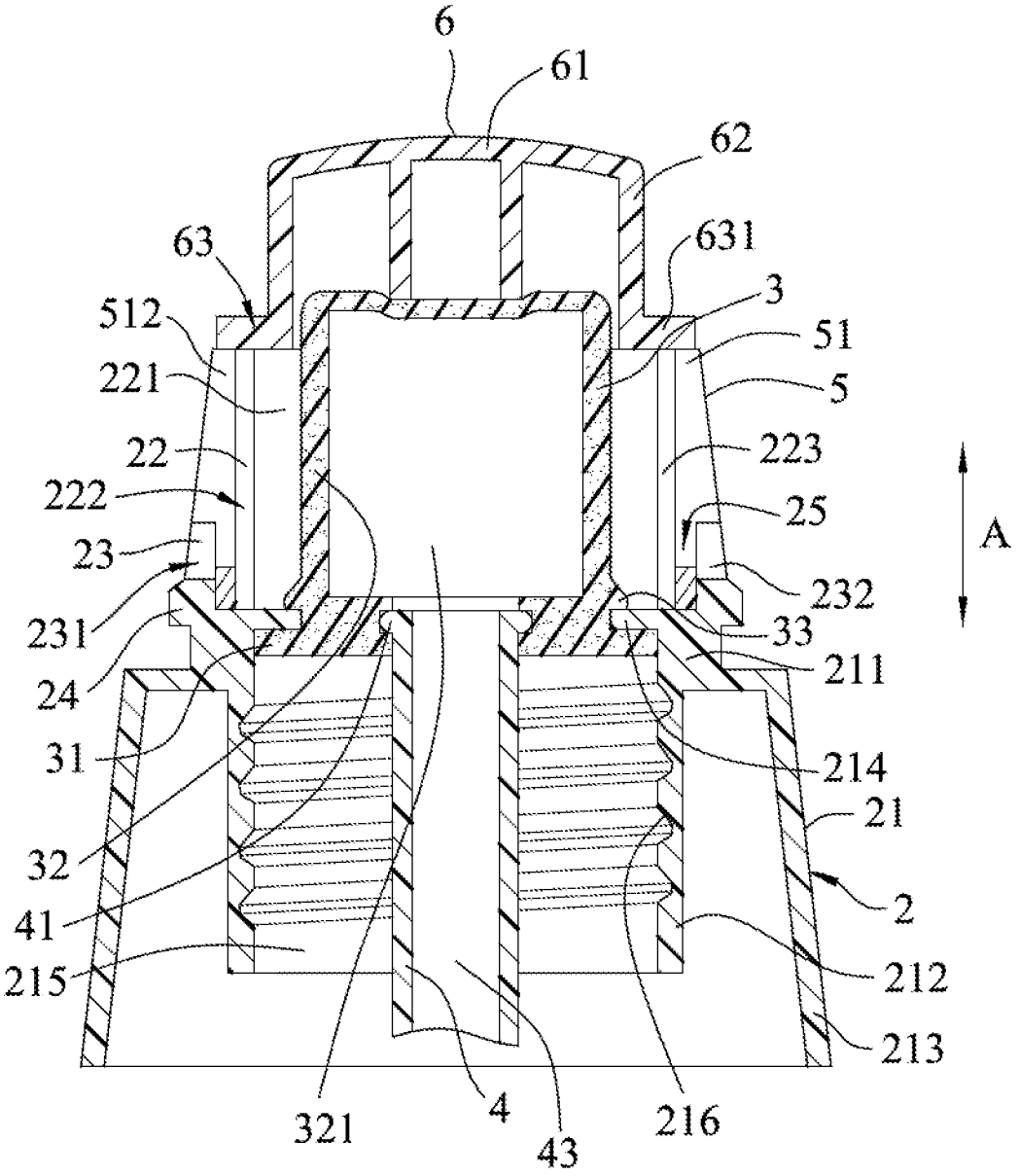
FIG. 2 is a fragmentary sectional view of the exemplary embodiment, illustrating relative positions of a mounting seat, an elastic cap, a regulating member and a press button.

Referring to FIGS. 1 to 2, an exemplary embodiment of a quantitative dispensing device according to this disclosure is used with a container 8 for dispensing a preselected quantity of flowable material (not shown). The container 8 is used for containing the flowable material therein, and has a threaded neck portion 81. The quantitative dispensing device includes a mounting seat 2, an elastic cap 3, a hollow dispensing element 4, a regulating member 5, a press button 6 and a rotatable seat 7.

The mounting seat 2 includes a hollow base body 21, a first surrounding wall 22 and a second surrounding wall 23.

The base body 21 has a neck portion 211, a tubular wall portion 212, a skirt portion 213 and an inward flange 214. The tubular wall portion 212 extends downwardly from the neck portion 211, defines a container-receiving space 215, and has an internally threaded portion 216 for threadedly engaging the threaded neck portion 81 of the container 8. The skirt portion 213 extends downwardly and outwardly from the neck portion 211, is spaced apart from the tubular wall portion 212, and surrounds the tubular wall portion 212. The inward flange 214 extends radially and inwardly from an inner surface of the neck portion 211.

The first surrounding wall 22 extends upwardly from the neck portion 211 of the base body 21, has an annular cross section, and defines an accommodating space 221 that spatially communicates with the container-receiving space 215. The first surrounding wall 22 includes a slide slot unit 222 formed with three equiangularly spaced-apart slide slots 223 that extend downwardly from a top edge of the first surrounding wall 22 and that spatially communicate with the accommodating space 221.

Figure 3:
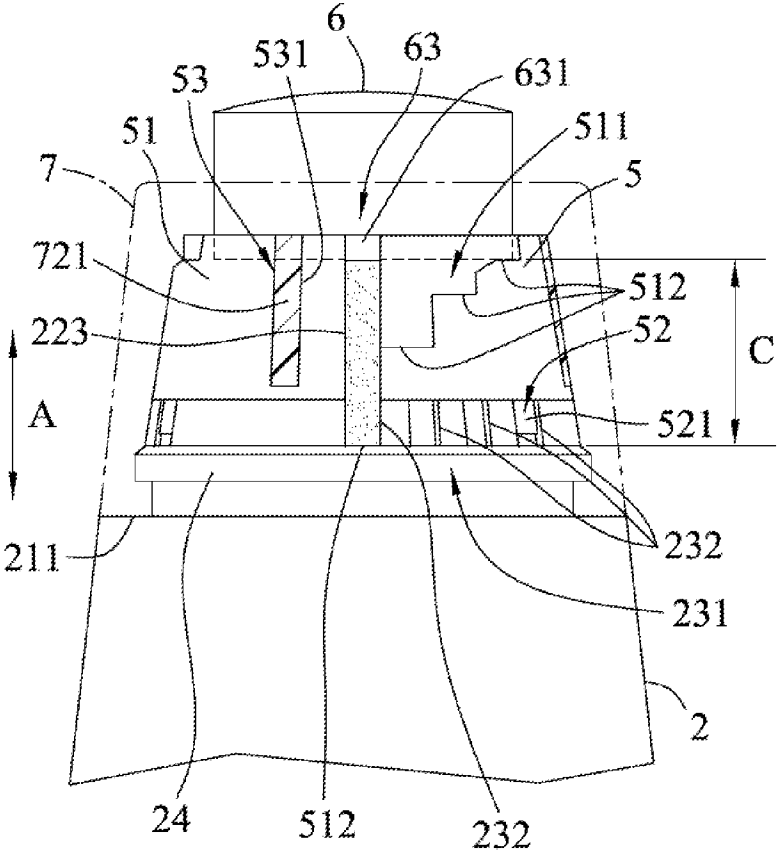
FIG. 3 is a fragmentary schematic view of the exemplary embodiment, illustrating the press button at a raised position where a positioning block of the press button is spaced apart from one of contacting surface portions of the regulating member.
Figure 4:
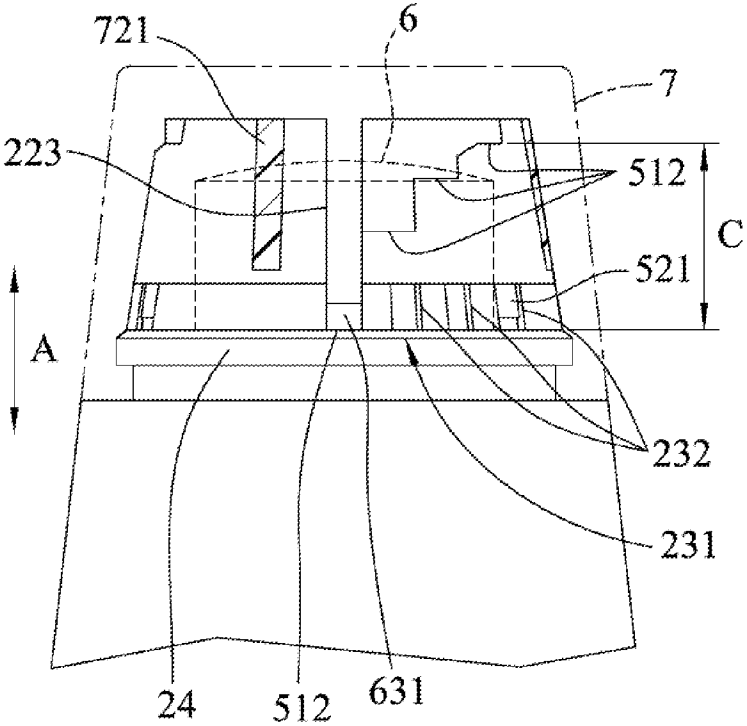
FIG. 4 is a view similar to FIG. 3, but illustrating the press button at a pressed position where the positioning block is in contact with the one of the contacting surface portions.

The second surrounding wall 23 extends upwardly from the neck portion 211 of the base body 21, surrounds and is spaced apart from the first surrounding wall 22, and cooperates with the first surrounding wall 22 to define a retaining groove 25 therebetween. The second surrounding wall 23 includes three equiangularly spaced-apart position-limiting units 231, each of which is formed with a plurality of spaced-apart notches 232 formed in a top edge of the second surrounding wall 23. For each of the position-limiting units 231, a leftmost one of the notches 232 (as shown in FIG. 1) is aligned with a respective one of the slide slots 223 as shown in FIGS. 3 and 4. In this embodiment, the first surrounding wall 22 has a height away from the base body 21 that is greater than that of the second surrounding wall 23. In certain embodiments, the height of the second surrounding wall 23 may be one third of that of the first surrounding wall 22.

The mounting seat 2 further includes an annular flange 24 that extends radially and outwardly from a bottom end of the second surrounding wall 23, and is located under the position-limiting units 231.

The elastic cap 3 includes a cap body 32, a bottom extension wall 31 and a positioning flange 33. The cap body 32 has a generally inverted U-shaped longitudinal section and defines an air-containing space 321. The bottom extension wall 31 extends radially and outwardly from a bottom end of the cap body 32. The positioning flange 33 protrudes outwardly from the cap body 32, and is disposed above and spaced apart from the bottom extension wall 31. The positioning flange 33 and the bottom extension wall 31 cooperatively clamp the inward flange 214 of the base body 21 therebetween such that the elastic cap 3 is fixedly disposed in the accommodating space 221.

The dispensing element 4 includes an upper open end 41 that is securely connected to the bottom extension wall 31, and a lower open end 42 that is opposite to the upper open end 41 and that is submerged in the flowable material in the container 8. The dispensing element 4 defines a connecting space 43 that spatially communicates with the air-containing space 321. In this embodiment, the dispensing element 4 is configured as a plastic tube that has a tilted bottom end portion 44 (see FIG. 1). In other variations of the embodiment, the structure and shape of the dispensing element 4 is not limited, and the elastic cap 3 and the dispensing element 4 may be integrally formed as a dropper.

The regulating member 5 is sleeved on the first surrounding wall 22 of the mounting seat 2 and is rotatable relative to the mounting seat 2. The regulating member 5 includes a hollow main body 51, three first engaging units 52 and a second engaging unit 53.

The main body 51 is annular, tapers upwardly, and fittingly and rotatably engages the retaining groove 25. The main body 51 includes three regulating units 511, each of which corresponds in position to a respective one of the slide slots 223, and has a stepped-shaped top surface that has a plurality of upwardly facing contacting surface portions 512. The contacting surface portions 512 have different heights away from a bottom edge of the main body 51.

The first engaging units 52 are respectively disposed below the regulating units 511, are equiangularly spaced apart, and respectively correspond in position to the position-limiting units 231 of the mounting seat 2. Each of the first engaging units 52 includes a protrusion 521 protruding outwardly from the main body 51, and is rotatable to engage removably a corresponding one of the notches 232 of a respective one of the position-limiting units 231 so as to fix the main body 51 in position relative to the mounting seat 2, such that a selected one of the contacting surface portions 512 of a respective one of the regulating units 511 is accurately aligned with a corresponding one of the slide slots 223.

The second engaging unit 53 is disposed at the main body 51, and is formed with three angularly spaced-apart engaging slots 531 that are spaced apart from and arranged alternately with the regulating units 511. In this embodiment, one of the engaging slots 531 has a width that is twice the width of the other ones of the engaging slots 531.

The rotatable seat 7 is disposed on and connected to an outer surface of the regulating member 5, is co-rotatable with the regulating member 5 relative to the mounting seat 2, and includes a hollow rotatable body 71 and a retaining unit 72. The rotatable body 71 has an annular cross section and is formed with an annular recess 711 fittingly engaging the annular flange 24 of the mounting seat 2. The retaining unit 72 includes three angularly spaced-apart retaining pieces 721 that are disposed on an inner surface of the rotatable body 71 and each engaging a respective one of the engaging slots 531 so as to permit the regulating member 5 to co-rotate with the rotatable seat 7. In greater detail, one of the retaining pieces 721 has a width greater than the other ones of the retaining pieces 721 so as to engage the one of the engaging slots 531 that has a greater width. The numbers of the engaging slots 531 and of the retaining pieces 721 are not limited to three and may be one, two, four, etc. in other variations of the embodiment.

The press button 6 is disposed above the elastic cap 3, and includes a circular top wall 61, a peripheral wall 62 that extends downwardly from the top wall 61, and a positioning unit 63. The positioning unit 63 includes three equiangularly spaced-apart positioning blocks 631 that protrude radially and outwardly from the peripheral wall 62. Each of the positioning blocks 631 extends through a respective one of the slide slots 223, and is slidable along the respective one of the slide slots 223 in a movement direction (A) (see FIG. 2).

Referring to FIGS. 1, 3 and 4, the press button 6 is movable in the movement direction (A) relative to the mounting seat 2 between a raised position and a pressed position. At the raised position (see FIG. 3), each of the positioning blocks 631 is spaced apart from the selected one of the contacting surface portions 512 of the respective one of the regulating units 511 in the movement direction (A), and the press button 6 is not pressed downwardly against the elastic cap 3. At the pressed position (see FIG. 4), each of the positioning blocks 631 is moved downwardly by a distance (C) and abuts against the selected one of the contacting surface portions 512 of a respective one of the regulating units 511, and the press button 6 is pressed downwardly against the elastic cap 3.

In this embodiment, the press button 6 is partially disposed in the rotatable body 71 at the raised position. In other variations of the embodiment, the press button 6 may be completely disposed in the rotatable body 71 at the raised position.

For the sake of clarity, only one of the regulating units 511 is illustrated and described in the following description.

When in use, the rotatable seat 7 is operated to rotate, e.g., manually, and the regulating member 5 co-rotates with the rotatable seat 7 until the selected one of the contacting surface portions 512 is aligned with the respective one of the slide slots 223. In this example, the selected one of the contacting surface portions 512 is the leftmost one in the FIG. 3. Next, the press button 6 is pressed downwardly to the pressed position so that the elastic cap 3 is pressed and deformed to expel air from the air-containing space 321 through the dispensing element 4, and that the elastic cap 3 stores a restoring force capable of returning the press button 6 to the raised position. When the press button 6 is released, the elastic cap 3 generates a suction force for drawing the flowable material into the dispensing element 4, and returns the press button 6 to the raised position via the restoring force. As a result, the flowable material is drawn into and stored in the connecting space 43 of the dispensing element 4. At this time, the container 8 can be unscrewed and separated from the quantitative dispensing device, and the press button 6 can be pressed again to the pressed position to dispense out the flowable material in the connecting space 43.

Figure 6:
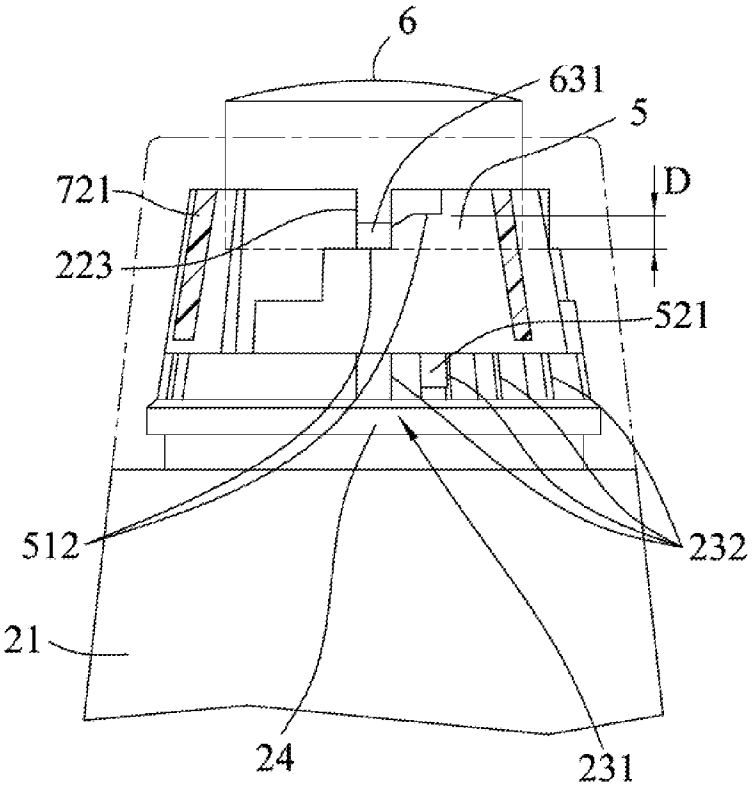
FIG. 6 is a view similar to FIG. 5, illustrating that the press button is moved to the pressed position after the quantity of the flowable material to be dispensed is adjusted.
Figure 5:
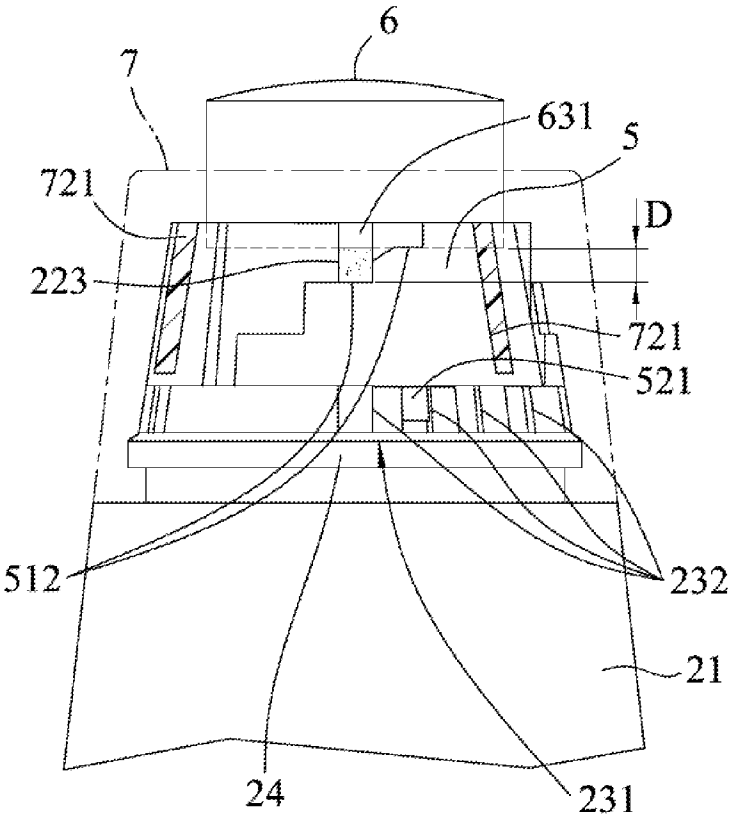
FIG. 5 is a view similar to FIG. 3, but illustrating how the quantity of a flowable material to be dispensed is adjusted.

A user can change the amount of the flowable material to be dispensed out by rotating the rotatable seat 7. For example, as shown in FIGS. 5 and 6, the rotatable seat 7 along with the regulating member 5 is rotated in a counter-clockwise direction until another one of the contacting surface portions 512, which has a higher height, is aligned with the respective one of the slide slots 223. The press button 6 is moved downwardly by a distance (D), which is shorter than the distance (C), at the pressed position. Therefore, the amount of the flowable material drawn into the connecting space 43 is less. It should be noted that the rotatable seat 7 can be rotated clockwise or counter-clockwise with no restriction.

As the rotatable seat 7 is rotated, each of the protrusions 521 of the first engaging units 52, which engages the corresponding one of the notches 232 of the respective one of the position-limiting units 231, is co-rotated to engage an adjacent one of the notches 232 of the respective one of the position-limiting units 231, and a resistance force due to contact with a section of the second surrounding wall 23 defining the adjacent notch 232 is experienced by the user. After the protrusion 521 is engaged into the adjacent one of the notches 232, the resistance force is removed and a click sound is created, thereby providing both tangible and audible signals to the user that different ones of the contacting surface portions 512 of the regulating units 511 are respectively aligned with the slide slots 223.

It should be noted that, in other variations of the embodiment, the numbers of the regulating units 511, of the slide slots 223, and of the positioning blocks 631 are not limited to three and may be one, two, four, etc., with no particular restriction.

To sum up, the contacting surface portions 512 of each of the regulating units 511 are configured to have different heights away from the bottom surface of the main body 51 of the regulating member 5, such that the distance that the press button 6 travelled from the raised position to the pressed position is different when a different one of the contacting surface portions 512 of each of the regulating units 511 is rotatable to align with the respective one of the slide slots 223 to allow the user to select a desired amount of the flowable material to be dispensed out. The quantitative dispensing device disclosed in this disclosure permits a preselected quantity of the flowable material pre-stored in the dispensing element 4 to be dispensed out readily and conveniently.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A quantitative dispensing device adapted for dispensing a preselected quantity of flowable material, said quantitative dispensing device comprising:

a mounting seat including a hollow base body and a first surrounding wall that extends upwardly from said base body, that defines an accommodating space, and that includes a slide slot unit extending downwardly from a top edge of said first surrounding wall;

an elastic cap fixedly disposed in said accommodating space and defining an air-containing space;

a hollow dispensing element including an upper open end that is connected to said elastic cap, and a lower open end that is opposite to said upper open end;

a regulating member sleeved on said first surrounding wall of said mounting seat, rotatable relative to said mounting seat, and including a main body that includes at least one regulating unit, said at least one regulating unit having a stepped-shaped top surface that has a plurality of contacting surface portions having different heights away from a bottom edge of said main body;

a rotatable seat disposed on and connected to an outer surface of said regulating member, co-rotatable with said regulating member relative to said mounting seat, and being operable to rotate so as to permit a selected one of said contacting surface portions to correspond in position to said slide slot unit of said mounting seat; and a press button disposed above said elastic cap and including a positioning unit that is slidable along said slide slot unit, wherein said press button is movable in a movement direction relative to said mounting seat between a raised position, where said positioning unit is spaced apart from said selected one of said contacting surface portions and said press button is not pressed downwardly against said elastic cap, and a pressed position, where said positioning unit abuts against said selected one of said contacting surface portions and said press button is pressed downwardly against said elastic cap, so that said elastic cap is deformed to expel air from said air-containing space through said dispensing element, and that said elastic cap stores a restoring force capable of returning said press button to the raised position and generates a suction force for drawing the flowable material into said dispensing element when said press button is released.

2. The quantitative dispensing device as claimed in claim 1, wherein:

said mounting seat further includes a second surrounding wall that extends upwardly from said base body, that surrounds and is spaced apart from said first surrounding wall, and that cooperates with said first surrounding wall to define a retaining groove therebetween; and said main body of said regulating member being fittingly and rotatably engaged in said retaining groove.

3. The quantitative dispensing device as claimed in claim 2, wherein:

said second surrounding wall of said mounting seat includes a position-limiting unit that is formed with a plurality of spaced-apart notches formed in a top edge of said second surrounding wall; and said regulating member further includes a first engaging unit that corresponds in position to said position-limiting unit, that includes a protrusion protruding outwardly from said main body and rotatable to engage removably a corresponding one of said notches so as to fix said main body in position such that said selected one of said contacting surface portions is aligned with said slide slot unit of said mounting seat.

4. The quantitative dispensing device as claimed in claim 2, wherein:

said second surrounding wall includes a plurality of angularly spaced-apart position-limiting units, each of which has a plurality of spaced-apart notches formed in a top edge of said second surrounding wall; and said regulating member further includes a plurality of first engaging units that respectively correspond in position to said position-limiting units, each of said first engaging units including a protrusion protruding outwardly from said main body, and being rotatable to engage removably a corresponding one of said notches of a respective one of said position-limiting units so as to fix said main body in position relative to said mounting seat such that said selected one of said contacting surface portions is aligned with said slide slot unit.

5. The quantitative dispensing device as claimed in claim 2, wherein said mounting seat further includes an annular flange extending outwardly from said second surrounding wall, said rotatable seat including a rotatable body that has an annular cross section and that is formed with an annular recess fittingly engaging said annular flange.

6. The quantitative dispensing device as claimed in claim 2, wherein said regulating member further includes a second engaging unit that is disposed at said main body and that is spaced apart from said at least one regulating unit, said rotatable seat including a rotatable body and a retaining unit that is disposed on an inner surface of said rotatable body and that engages said second engaging unit so as to permit said regulating member to co-rotate with said rotatable seat.

7. The quantitative dispensing device as claimed in claim 6, wherein said second engaging unit of said regulating member is formed with a plurality of angularly spaced-apart engaging slots, said retaining unit of said rotatable seat including a plurality of angularly spaced-apart retaining pieces each engaging a respective one of said engaging slots.

8. The quantitative dispensing device as claimed in claim 7, wherein said regulating member includes a plurality of said regulating units, said engaging slots of said second engaging unit being arranged alternately with said regulating units.

9. The quantitative dispensing device as claimed in claim 1, wherein:

said slide slot unit is formed with a plurality of angularly spaced-apart slide slots;

said main body of said regulating member includes a plurality of said regulating units, each of said regulating units corresponding in position to a respective one of said slide slots; and said positioning unit of said press button includes a plurality of angularly spaced-apart positioning blocks each being slidable along the respective one of said slide slots.

10. The quantitative dispensing device as claimed in claim 1, wherein said dispensing element is configured as a plastic tube.

11. The quantitative dispensing device as claimed in claim 1, wherein said rotatable seat includes a hollow rotatable body, said press button being at least partially disposed in said rotatable body.

12. The quantitative dispensing device as claimed in claim 1, wherein said first surrounding wall of said mounting seat has a height away from said base body that is greater than that of said second surrounding wall.

* * * * *